US010640331B2

(12) United States Patent
Kakio et al.

(10) Patent No.: US 10,640,331 B2
(45) Date of Patent: May 5, 2020

(54) ELEVATOR SAFETY DEVICE AND ELEVATOR SYSTEM

(71) Applicant: MITSUBISHI ELECTRIC CORPORATION, Chiyoda-ku (JP)

(72) Inventors: Masayuki Kakio, Chiyoda-ku (JP); Seiji Watanabe, Chiyoda-ku (JP); Naohiro Shiraishi, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 251 days.

(21) Appl. No.: 15/552,866

(22) PCT Filed: Jan. 14, 2016

(86) PCT No.: PCT/JP2016/051017
§ 371 (c)(1),
(2) Date: Aug. 23, 2017

(87) PCT Pub. No.: WO2016/147686
PCT Pub. Date: Sep. 22, 2016

(65) Prior Publication Data

US 2018/0044136 A1 Feb. 15, 2018

(30) Foreign Application Priority Data

Mar. 18, 2015 (JP) ..... 2015-054465

(51) Int. Cl.
*B66B 5/22* (2006.01)

(52) U.S. Cl.
CPC ..... *B66B 5/22* (2013.01)

(58) Field of Classification Search
CPC .. B66B 5/16; B66B 5/18; B66B 5/185; B66B 5/20; B66B 5/22; B66B 5/24
See application file for complete search history.

(56) References Cited

U.S. PATENT DOCUMENTS 1,581,458 A * 4/1926 Lindquist ..... B66B 5/22 187/343
5,224,570 A 7/1993 Fromberg
(Continued)

FOREIGN PATENT DOCUMENTS

JP 04-286584 A 10/1992
JP 05-238659 A 9/1993
(Continued)

OTHER PUBLICATIONS

International Search Report dated Apr. 12, 2016 in PCT/JP2016/051017, filed on Jan. 14, 2016.

*Primary Examiner* — Minh Truong
(74) *Attorney, Agent, or Firm* — Oblon, McClelland, Maier & Neustadt, L.L.P.

(57) ABSTRACT

An elevator emergency safety device includes: a damper that includes a first sliding surface, and that is pressed against a guide rail to generate a braking force; a movable member that includes a second sliding surface that contacts the first sliding surface; and an elastic body that applies to the first sliding surface a pressing force that presses the damper against the guide rail, wherein: the damper is configured so as to be movable in a vertical direction relative to the movable member by the first and second sliding surfaces sliding; and the elastic body is configured such that the pressing force F1 increases, reaches a maximum value, and then decreases, as a position of a contacting portion between the first and second sliding surfaces moves upward.

6 Claims, 10 Drawing Sheets

(56) References Cited

U.S. PATENT DOCUMENTS

| | | | | |
|---|---|---|---|---|
| 6,026,936 | A * | 2/2000 | Aulanko | B66B 5/18 187/376 |
| 6,109,398 | A | 8/2000 | Lempiö et al. | |
| 8,312,972 | B2 * | 11/2012 | Gremaud | B66B 5/22 187/371 |

FOREIGN PATENT DOCUMENTS

| | | | |
|---|---|---|---|
| JP | 07-015668 | U | 3/1995 |
| JP | 10-152271 | A | 6/1998 |
| JP | 10-152272 | A | 6/1998 |
| JP | 2001-192184 | A | 7/2001 |
| JP | 2014-065591 | A | 4/2014 |
| JP | 2015-009981 | A | 1/2015 |

* cited by examiner

COMPARATIVE EXAMPLE

ELEVATOR SAFETY DEVICE AND ELEVATOR SYSTEM

TECHNICAL FIELD

The present invention relates to an elevator safety device and an elevator system that makes a hoisted body such as a car or a counterweight perform emergency stopping when a descent speed of the hoisted body exceeds a constant velocity.

BACKGROUND ART

Conventionally, elevators are equipped with emergency safety devices in which a speed governor is activated and presses a wedge-shaped damper against a guide rail when a descent speed of a hoisted body such as a car or a counterweigh exceeds a fixed velocity, to brake the hoisted body using frictional force that arises between the damper and the guide rail.

However, braking force on the hoisted body varies due to differences in the coefficients of friction between the damper and the guide rail. In other words, even if a normal component of reaction with which a braking surface of the damper pushes against a braking surface of the guide rail is constant, the braking force, i.e., frictional force, changes depending on the state of the braking surfaces or braking speed. Thus, one problem has been that because the braking speed is fast and frictional force is small when deceleration starts, the deceleration rate is low, and because braking speed becomes slow and the frictional force becomes large as deceleration finishes, deceleration rate increases rapidly.

In consideration of such conditions, conventional emergency safety devices have been proposed that are equipped with a mechanism by which dimensions of a wedge-shaped damper in a direction that is perpendicular to a braking surface of a guide rail change so as to equal braking force (see Patent Literature 1, for example). In the conventional emergency safety devices, the dimensions of the damper change in response to changes in braking force to change the pressing force from an elastic body. Here, the pressing force of the elastic body changes so as to cancel out fluctuations in braking force, such that the braking force is kept constant. In this manner, the conventional emergency safety devices operate automatically to suppress fluctuations in braking force when changes in braking force are detected, suppressing changes in the deceleration rate.

CITATION LIST

Patent Literature

Patent Literature 1: Japanese Patent Laid-Open No. 2001-192184 (Gazette)

SUMMARY OF THE INVENTION

Problem to be Solved by the Invention

In conventional emergency safety devices, the damper has a configuration that is divided into: a wedge-shaped fixed portion that has an outer inclined surface portion and an inner inclined surface; and a wedge-shaped movable portion that has a braking surface, and the wedge-shaped movable portion is connected to the fixed portion by means of an elastic body, and is configured so as to be movable parallel to the inner inclined surface of the fixed portion together with deformation of the elastic body. Thus, because the braking surface is reduced in size when attempts are made to reduce the damper in size, one problem has been that irregularities in braking force are increased. If attempts are made to increase the size of the braking surface in order to suppress irregularities in braking force, on the other hand, then because the damper is increased in size, leading to increases in the size of the emergency safety device, and one problem has been that weight is increased, making electric power utilization efficiency of the elevator system poor.

The present invention aims to solve the above problems and an object of the present invention is to provide an elevator safety device and an elevator system that suppress increases in damper size and suppress fluctuations in braking force, that can increase electric power utilization efficiency, and that can also suppress fluctuations in deceleration rate.

Means for Solving the Problem

An elevator emergency safety device according to the present invention includes: a damper that is disposed so as to be reciprocally movable in a direction of approach to and a direction of separation from a guide rail, and so as to be movable in a vertical direction along the guide rail, that includes a first sliding surface on a surface on an opposite side from the guide rail, and that is pressed against the guide rail to generate a braking force; a movable member that is disposed on a side of the damper near the first sliding surface, and that includes a second sliding surface that contacts the first sliding surface; and a pressing force applying portion that generates a pressing force that presses the damper against the guide rail, wherein: the damper is configured so as to be movable in a vertical direction relative to the movable member by the first sliding surface and the second sliding surface sliding; and the pressing force applying portion is configured such that the pressing force increases, reaches a maximum value, and then decreases, as a position of a contacting portion between the first sliding surface and the second sliding surface moves upward.

Effects of the Invention

According to the present invention, as braking force increases, a damper moves vertically upward, and a position of a contacting portion between a first sliding surface and a second sliding surface moves upward. A pressing force increases, exceeds a maximum value, and then decreases, as the position of the contacting portion between the first sliding surface and the second sliding surface moves upward. Thus, if the braking force increases in a state in which the pressing force has reached the maximum value, the pressing force increases. Then, in a state in which the pressing force has exceeded the maximum value, the pressing force is reduced if the braking force increases, so as to cancel out the increase in the braking force, and the pressing force is increased if the braking force decreases, so as to cancel out the decrease in the braking force. In this manner, changes in the deceleration rate are suppressed by operating automatically to suppress fluctuations in braking force when changes in braking force are detected.

Furthermore, because it is not necessary to divide the damper into a wedge-shaped fixed portion that includes an outer inclined portion and an inner inclined portion, and a wedge-shaped movable portion that includes a braking surface, and it is not necessary to dispose an elastic body that bears the braking force, braking surface area can be ensured without increasing the damper in size, enabling irregularities in braking force to be suppressed. In addition, because increases in the size of the damper can be suppressed, the emergency safety device can be reduced in weight, enabling the electric power utilization efficiency of the elevator system to be increased.

DESCRIPTION OF EMBODIMENTS

Embodiment 1

Figure 1:
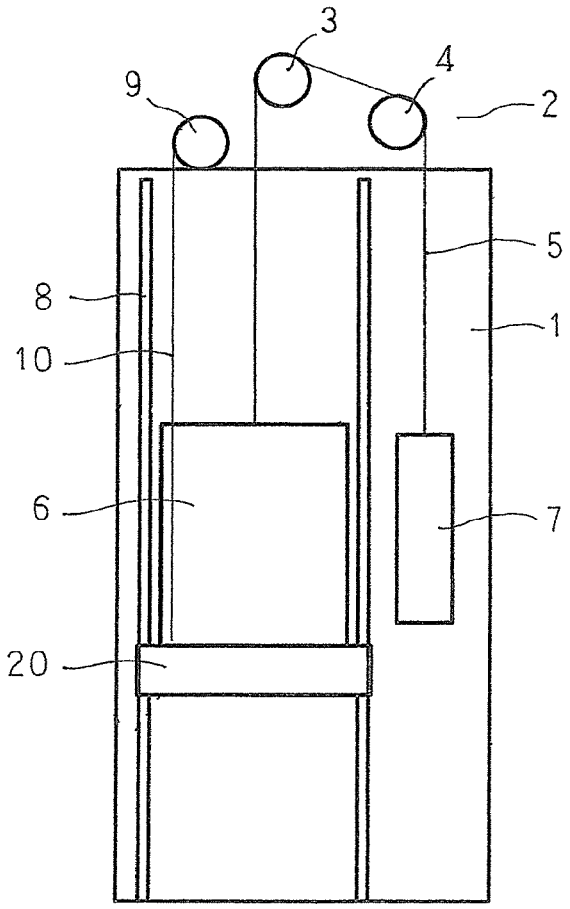
FIG. 1 is a schematic diagram that shows an elevator system according to Embodiment 1 of the present invention.
Figure 2:
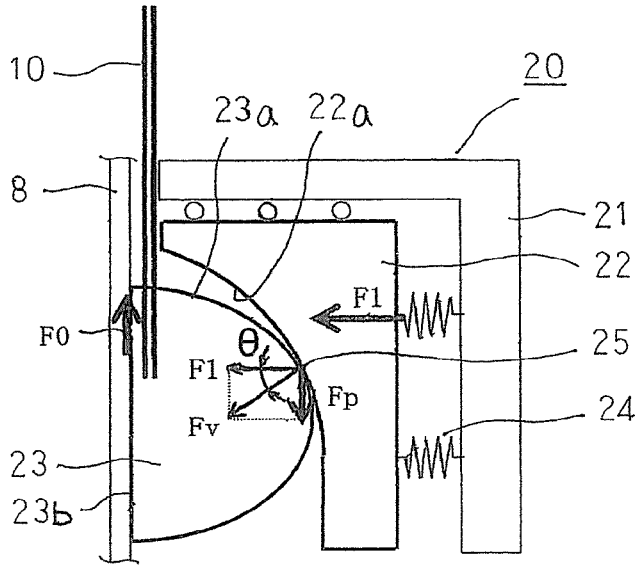
FIG. 2 is a schematic diagram that explains a braking mechanism of an elevator emergency safety device according to Embodiment 1 of the present invention.
Figure 3:
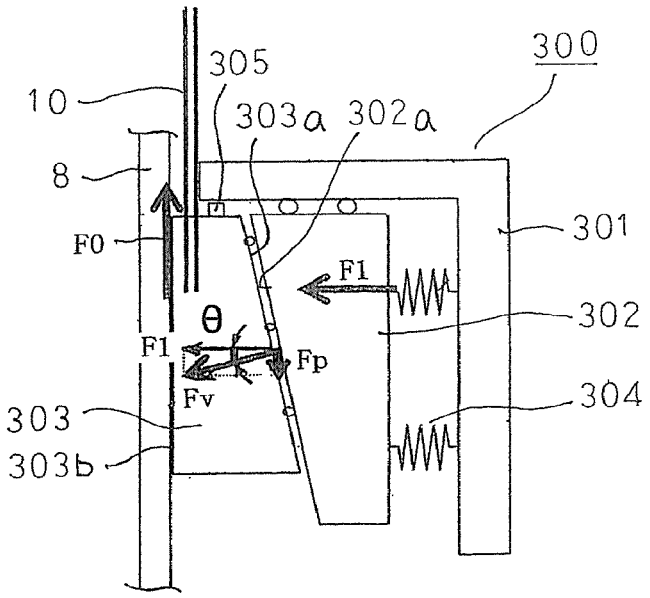
FIG. 3 is a schematic diagram that explains a braking mechanism of a comparative elevator emergency safety device.

FIG. 1 is a schematic diagram that shows an elevator system according to Embodiment 1 of the present invention, FIG. 2 is a schematic diagram that explains a braking mechanism of an elevator emergency safety device according to Embodiment 1 of the present invention, and FIG. 3 is a schematic diagram that explains a braking mechanism of a comparative elevator emergency safety device.

In FIG. 1, a driving sheave 3 and a deflecting sheave 4 are installed inside a machine room 2 that is formed in an upper portion of a hoistway 1, and a car 6 and a counterweight 7 are suspended by a main rope that is looped around the driving sheave 3 and the deflecting sheave 4 and is hung down inside the hoistway 1. The car 6 and the counterweight 7 are disposed hoistably so as to be guided by guide rails 8 (only those for the car are depicted) that are disposed so as to extend vertically inside the hoistway 1.

An emergency safety device 20 is mounted to the car 6, and is configured so as to grip the guide rails 8 to stop the car 6 mechanically if the main rope 5 breaks, or if a rotational speed of the driving sheave 3 becomes abnormal, and a descent speed of the car 6 becomes greater than or equal to a rated velocity (a specified value).

A speed governor rope 10 is looped around a speed governor 9 that is installed inside the machine room 2 and a tensioning sheave (not shown) that is installed inside a pit (not shown). The speed governor rope 10 is linked to the car 6 by means of a lifting apparatus (not shown), and circulates interdependently with the hoisting of the car 6.

In an elevator system that is configured in this manner, the driving sheave 3 is driven and controlled by an elevator controlling board (not shown) such that the car 6 and the counterweight 7 ascend and descend through the hoistway 1 so as to be guided by the guide rails 8. Here, the speed governor rope 10 circulates interdependently with the raising and lowering of the car 6, and the speed governor 9 detects the velocity of the car 6 by means of the speed governor rope 10. Then, if the speed governor 9 detects overspeeding of the car 6, a rope-gripping portion (not shown) that is incorporated into the speed governor 9 is activated such that the speed governor rope 10 that is wound onto the speed governor 9 is gripped. The emergency safety device 20 is thereby activated such that the car 6 is stopped mechanically.

Next, configuration of the emergency safety device 20 will be explained with reference to FIG. 2. Here, the guide rails 8 are produced so as to have a T shape in which a head portion protrudes from a base portion centrally in a width direction. To facilitate explanation, a direction that is perpendicular to both a longitudinal direction of the guide rails 8 and a direction of projection of the head portion from the base portion will be designated the width direction of the guide rails 8. Moreover, the width direction of the guide rails 8 is a direction that is perpendicular to a braking surface, which is a side surface of the head portion. Furthermore, the longitudinal direction of the guide rails 8 is oriented vertically.

The emergency safety device 20 includes: a fixed member 21 that is mounted to the car 6, and that is disposed on a first side in a width direction of a guide rail 8; a movable member 22 that is disposed between the fixed member 21 and the guide rail 8 such that a second sliding surface 22*a* faces toward the guide rail 8, so as to be reciprocally movable in the width direction of the guide rail 8; a damper 23 that is disposed between the movable member 22 and the guide rail 8 such that a first sliding surface 23*a* faces toward the second sliding surface 22*a*, so as to be reciprocally movable in the width direction of the guide rail 8 and reciprocally movable in the longitudinal direction of the guide rail 8; and an elastic body 24 that is disposed between the fixed member 21 and the movable member 22, and that forces the movable member 22 toward the guide rail 8. Moreover, the fixed member 21 is mounted to the car 6, but a portion of the car 6 may be used as the fixed member 21.

A braking mechanism of the emergency safety device 20 according to the present application will now be explained in comparison to a braking mechanism of a comparative emergency safety device 300.

First, the braking mechanism of the comparative emergency safety device 300 will be explained using FIG. 3. The comparative emergency safety device 300 includes: a fixed member 301 that is mounted to a car 6, and that is disposed on a first side in a width direction of a guide rail 8; a wedge-shaped fixed portion 302 that is disposed between the fixed member 301 and the guide rail 8 such that an inclined surface 302*a* faces toward the guide rail 8, so as to be reciprocally movable in the width direction of the guide rail 8; a wedge-shaped damper 303 that is disposed between the fixed portion 302 and the guide rail 8 such that a inclined surface 303*a* faces toward the inclined surface 302*a*, so as to be reciprocally movable in the width direction of the guide rail 8 and reciprocally movable in the longitudinal direction of the guide rail 8; an elastic body 304 that is disposed between the fixed member 301 and the fixed portion 302, and that forces the fixed portion 302 toward the guide rail 8; and a stopper 305 that restricts upward movement of the damper 303. Moreover, the inclined surfaces 302*a* and 303*a* are formed into flat surfaces that are mutually parallel.

A speed governor rope 10 is connected to the damper 303. Here, the damper 303 is pulled upward relative to the car 6 when the speed governor rope 10 is gripped. The damper 303 thereby approaches the guide rail 8 while moving upward along the inclined surface 302*a*. A braking surface 303*b* that is formed on an opposite side of the damper 303 from the inclined surface 303*a* is thereby placed in contact with the braking surface on the head portion of the guide rail 8. In addition, the fixed portion 302 moves away from the guide rail 8 as the damper 303 moves upward. The elastic body 304 thereby contracts, generating a pressing force F1. A frictional force F0 (=F1×μ) is then generated between the guide rail 8 and the damper 303. This frictional force F0 is a braking force. Moreover, μ is a coefficient of friction between the guide rail 8 and the damper 303.

A normal component of reaction Fv of the inclined surface 313 is generated by the pressing force F1 of the elastic body 304 acting on the fixed portion 302. Here, an angle θ that is formed between the normal component of reaction Fv and the pressing force F1 is an angle that is formed between the inclined surface 313 and the vertical direction, i.e., an angle of inclination of the inclined surface 313.

Because the braking force F0 is constantly greater than the vertical component Fp of the normal component of reaction Fv if tan θ<μ, the damper 303 would continue to ascend relative to the fixed portion 302 if there were no stopper 305. Thus, the stopper 305 is disposed to stop the ascent of the damper 303. The amount of movement of the fixed portion 302 away from the guide rail 8 is thereby uniquely determined, and the value of the pressing force F1 is thereby determined by the elastic body 304. Thus, because the pressing force F1 is a constant value, the braking force F0 fluctuates as the coefficient of friction varies. Consequently, fluctuations in the braking force F0 cannot be suppressed in the comparative emergency safety device 300, preventing changes in deceleration rate from being suppressed.

Because the braking force F0 is constantly less than the vertical component Fp of the normal component of reaction Fv if tan θ>μ, the damper 303 cannot ascend relative to the fixed portion 302. Thus, the damper 303 cannot enter between the fixed portion 302 and the guide rail 8, and the braking force F0 is not generated. Consequently, the comparative emergency safety device 300 will not function.

If tan θ=μ, the braking force F0 is equal to the vertical component Fp of the normal component of reaction Fv. However, the coefficient of friction μ is determined by the materials of the guide rail 8 and the damper 303, the state of the sliding surface, etc., and changes depending on environmental changes. Angle θ, on the other hand, is determined by the angle of inclination of the inclined surface 313. Consequently, because tan θ cannot be made equal to μ, the forces will not balance in the comparative emergency safety device 300.

Next, the braking mechanism of the emergency safety device 20 will be explained using FIG. 2. Here, the second sliding surface 22*a* of the movable member 22 is formed so as to have a concave curved surface that displaces toward the guide rail 8 progressively upward. The first sliding surface 23*a* of the damper 23 is formed so as to have a convex curved surface that displaces toward the guide rail 8 progressively upward from an apex portion. The first and second sliding surfaces 22*a* and 23*a* come into contact on a line segment that is perpendicular to both the vertical direction and the width direction of the guide rail 8, in other words, they are in line contact.

The speed governor rope 10 is connected to the damper 23. Here, the damper 23 is pulled upward relative to the car 6 when the speed governor rope 10 is gripped. The damper 23 thereby approaches the guide rail 8 as the first sliding surface 23*a* slides on the second sliding surface 22*a* and moves upward. A braking surface 23*b* that is formed on an opposite side of the damper 23 from the first sliding surface 23*a* is thereby placed in contact with the braking surface on the head portion of the guide rail 8. In addition, the first sliding surface 23*a* slides upward on the second sliding surface 22*a*, and the movable member 22 moves away from the guide rail 8 as the damper 23 moves upward. The elastic body 24 thereby contracts, generating a pressing force F1. A frictional force F0 (=F1×μ) is then generated between the guide rail 8 and the damper 23. This frictional force F0 is a braking force. Moreover, μ is a coefficient of friction between the guide rail 8 and the damper 23.

A normal component of reaction Fv arises at the contacting portion 25 between the first and second sliding surfaces 22*a* and 23*a* due to the pressing force F1 of the elastic body 24 that acts on the movable member 22. The vertical component Fp of the normal component of reaction Fv acts so as to lower the damper 23 relative to the movable member 22 if greater than the braking force F0. On the other hand, the vertical component Fp of the normal component of reaction Fv acts so as to raise the damper 23 relative to the movable member 22 if less than the braking force F0. This action of the vertical component Fp could be said to be a detecting functioning for the braking force F0. Thus, in the emergency safety device 20, it becomes possible to use the detected braking force F0 to change and automatically adjust the pressing force F1 so as to suppress the fluctuations in the braking force F0, thereby suppressing changes in the deceleration rate.

Next, surface shapes of the first and second sliding surfaces 22*a* and 23*a* of the movable member 22 and the damper 23 will be explained in detail.

The first and second sliding surfaces 22*a* and 23*a* are in line contact at the contacting portion 25. This contacting portion 25 is a line segment that is perpendicular to both the longitudinal direction of the guide rail 8 and the width direction of the guide rail 8. A distance between the contacting portion 25 and the braking surface of the guide rail 8 in a direction that is perpendicular to the braking surface of the guide rail 8 (hereinafter called "a horizontal distance") becomes shorter as the damper 23 ascends relative to the movable member 22.

In order for the first and second sliding surfaces 22*a* and 23*a* to continue contacting continuously as the damper 23 ascends relative to the movable member 22, it is necessary for an angle θ that is formed between a normal at the contacting portion 25 between the first and second sliding surfaces 22*a* and 23*a* and a direction that is perpendicular to the braking surface of the guide rail 8 to increase continuously as the damper 23 ascends. In other words, it is necessary for the angle θ that is formed between the normal at the contacting portion 25 between the first and second sliding surfaces 22*a* and 23*a* and the direction that is perpendicular to the braking surface of the guide rail 8 to increase monotonically as the damper 23 ascends. Moreover, the angle θ equals the angle that is formed between the normal component of reaction Fv and the pressing force F1. In other words, the angle θ is an angle that is formed between a normal of a tangential plane at the contacting portion 25 and a horizontal plane.

Now, during the braking operation, it is not necessary for the entire surface of the first sliding surface 23*a* of the damper 23 to slide on the entire surface of the second sliding surface 22*a* of the movable member 22, provided that a region on a portion of the first sliding surface 23*a* of the damper 23 slides on a region on a portion of the second sliding surface 22*a* of the movable member 22. Thus, the first and second sliding surfaces 22*a* and 23*a* of the movable member 22 and the damper 23 should be formed such that the curved surface shape of at least the region where sliding actually occurs is in line contact at the contacting portion 25, the horizontal distance between the contacting portion 25 and the braking surface of the guide rail 8 becomes continuously shorter due to the relative ascent of the damper 23, and the angle θ at the contacting portion 25 increases monotonically due to the relative ascent of the damper 23.

As shown in FIG. 2, the pressing force F1 that is generated by the elastic body 24 is equal to the horizontal force at the contacting portion 25, and is expressed by F1=Fv×cos θ. If the coefficient of friction μ of the frictional force F0 (=F1×μ) of the damper 23 increases during braking, making the damper 23 ascend relative to the car 6, changes in frictional force F0 can be suppressed by having a function that reduces the pressing force F1 or the horizontal force (Fv×cos θ). If, on the other hand, the coefficient of friction μ of the frictional force F0 (=F1×μ) of the damper 23 decreases during braking, making the damper 23 descend relative to the car 6, changes in frictional force F0 can be suppressed by having a function that increases the pressing force F1 or the horizontal force (Fv×cos θ). In other words, it can be said that if the coefficient of friction μ of the damper 23 fluctuates during braking, making the damper 23 move up or down relative to the car 6, changes in frictional force F0 can be suppressed by having a function that changes the horizontal force (Fv×cos θ) in opposition thereto.

Next, combination of the curved surface shapes of the first and second sliding surfaces 22*a* and 23*a* will be explained.

First, if the second sliding surface 22*a* is constituted by a portion of a cylindrical surface and the first sliding surface 23*a* is constituted by a portion of a cylindrical surface that has a radius that is identical to that of the second sliding surface 22*a*, then the first and second sliding surfaces 22*a* and 23*a* come completely into surface contact. Thus, the damper 23 cannot ascend or descend relative to the movable member 22, and the automatic adjusting mechanism for the braking force F0 is lost.

Next, in the above-mentioned combination, the radius of only the second sliding surface 22*a* may be made slightly larger, or the radius of only the first sliding surface 23*a* may be made slightly smaller, or the radius of the second sliding surface 22*a* may be made slightly larger, and the radius of the first sliding surface 23*a* made slightly smaller. In these cases, the angle θ at the contacting portion 25 fluctuates significantly due to a small amount of relative ascent and descent of the damper 23 relative to the movable member 22. Here, the amount of movement of the movable member 22 in the width direction of the guide rail 8 is small, and the pressing force F1 fluctuates negligibly.

The radius of only the second sliding surface 22*a* may be made even larger, or the radius of only the first sliding surface 23*a* may be made even smaller, or the radius of the second sliding surface 22*a* may be made even larger, and the radius of the first sliding surface 23*a* made even smaller. In these cases, the angle θ at the contacting portion 25 fluctuates even more significantly due to a small amount of relative ascent and descent of the damper 23 relative to the movable member 22. Here, the amount of movement of the movable member 22 in the width direction of the guide rail 8 is significant, and the pressing force F1 fluctuates.

In this manner, the braking force F0 can be detected by measuring the amount of movement of the movable member 22 in the width direction of the guide rail 8 or the amount of ascent or descent of the damper 23 relative to the movable member 22.

Here, the amount of movement of the movable member 22 in the width direction of the guide rail 8 is ($r_{in}$ cos+$r_{out}$ cos), which can be used appropriately in design by a designer. Moreover, $r_{in}$ is the radius of the first sliding surface 23*a* of the damper 23, $r_{out}$ is the radius of the second sliding surface 22*a* of the movable member 22, and θ is the angle that is formed between the normal at the contacting portion 25 and the direction that is perpendicular to the braking surface of the guide rail 8.

Next, properties of the elastic body 24 will be explained.

Figure 4:
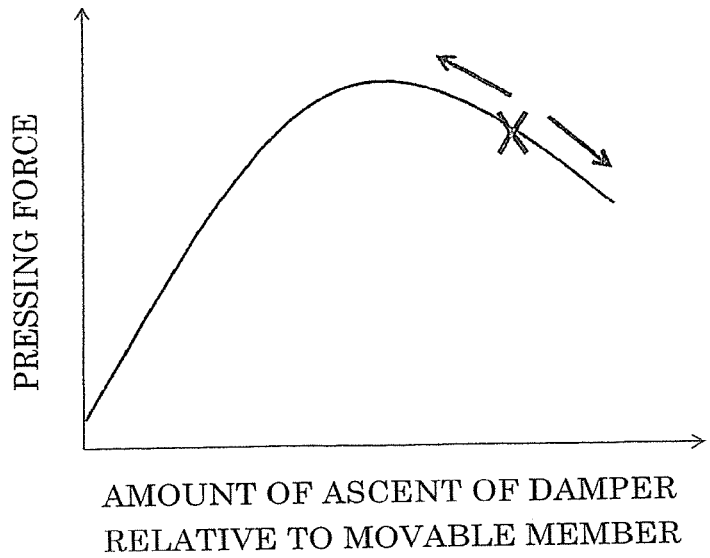
FIG. 4 is a graph that explains properties of an elastic body in the elevator emergency safety device according to Embodiment 1 of the present invention.

This elastic body 24 has a property by which a repulsive force increases as it is compressed, and decreases when a maximum value is exceeded. This repulsive force becomes the pressing force F1. In other words, in the action of the emergency safety device 20, if the damper 23 ascends relative to the movable member 22 together with increases in the braking force F0, increasing the angle θ at the contacting portion 25, and moving the movable member 22 to the right, then the pressing force F1 from the elastic body 24 increases, and decreases when a maximum value is exceeded, as shown in FIG. 4. Thus, because the braking force F0 increases significantly at the initial commencement of braking, and fluctuations in the braking force F0 are suppressed when the braking force F0 exceeds the maximum value, changes in the deceleration rate of the car 6 are suppressed. In other words, the emergency safety device 20 can automatically adjust fluctuations in the braking force F0 such that changes in the deceleration rate of the car 6 are suppressed.

If, on the other hand, the damper 23 descends relative to the movable member 22 together with reductions in the braking force F0, decreasing the angle θ at the contacting portion 25, and moving the movable member 22 to the left, then the pressing force F1 increases.

Thus, in this emergency safety device 20, a braking operation is performed using the property of the elastic body 24 by which the repulsive force increases together with increases in the amount of compression and reaches the maximum value, and suppression of fluctuations in the braking force F0 is performed using the property of the elastic body 24 by which the repulsive force decreases as the amount of compression increases beyond the maximum value.

Here, the elastic body 24 constitutes a pressing force applying portion. Furthermore, because the first sliding surface 23*a* and the second sliding surface 22*a* are configured so as to be in line contact, and such that the angle θ that is formed between the normal of the tangential plane at the contacting portion 25 and the horizontal plane is increased with the vertically upward movement of the contacting portion 25 relative to the damper 23, the amount of change in the pressing force F1 can be increased by a small amount of movement of the contacting portion 25, enabling the fluctuations in the braking force F0 to be suppressed effectively.

Next, mechanisms that utilize the property of the elastic body 24 by which the pressing force F1 decreases when the movable member 22 moves away from the guide rail 8 will be explained.

Figure 5:
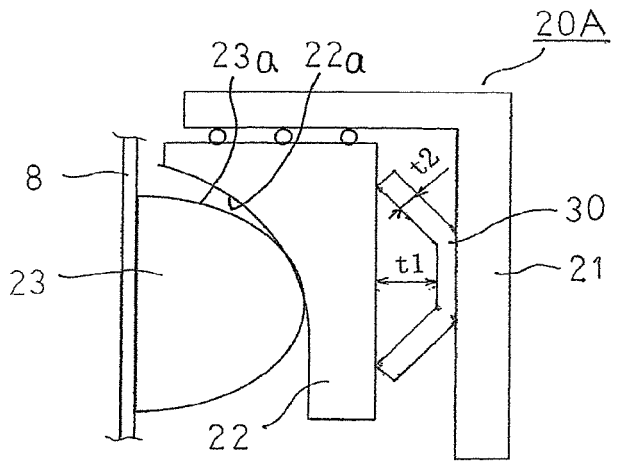
FIG. 5 is a schematic diagram that explains a configuration of a first variation of the elevator emergency safety device according to Embodiment 1 of the present invention.

FIG. 5 is a diagram that shows a first variation of the elevator emergency safety device according to Embodiment 1 of the present invention.

In FIG. 5, a disk spring 30 is produced so as to satisfy t1/t2≥1.4, where t1 is a contraction allowance, and t2 is a sheet thickness, and is disposed between the fixed member 21 and the movable member 22. Because the disk spring 30 is produced so as to satisfy t1/t2≥1.4, it has a property by which the pressing force F1 increases to a maximum value and then decreases, as the amount of contraction increases. Consequently, an emergency safety device 20A that uses the disk spring 30 as an elastic body can automatically adjust fluctuations in the braking force F0 so as to suppress changes in the deceleration rate of the car 6.

Figure 6:
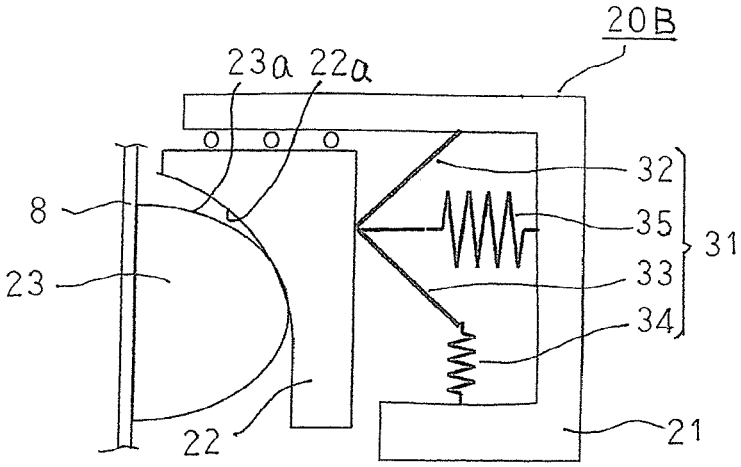
FIG. 6 is a schematic diagram that explains a configuration of a second variation of the elevator emergency safety device according to Embodiment 1 of the present invention.

FIG. 6 is a diagram that shows a second variation of the elevator emergency safety device according to Embodiment 1 of the present invention.

In FIG. 6, an elastic body 31 is a toggling mechanism that includes: a first link 32 that has a first end that is fixed to a fixed member 21; a second link 33 that has a first end that is linked to a second end of the first link 32, and that has a second end that is fixed to the fixed member 21 so as to have a first helical spring 33 interposed; and a second helical spring 35 that is disposed so as to force a movable member 22 toward a guide rail 8 so as to have the power point that is constituted by the linking portion between the first link 32 and the second link 33 interposed. The first link 32 can rotate freely around the point that is fixed to the fixed member 21, and the first link 32 and the second link 33 can rotate freely around the linking point between the two. The elastic body 31 that is configured in this manner has a property by which the pressing force F1 increases as an amount of separation of the movable member 22 from the guide rail 8 increases, and then decreases after the first link 32 and the second link 33 become straight at a maximum value. Consequently, an emergency safety device 20B that uses the elastic body 31 can automatically adjust fluctuations in the braking force F0 so as to suppress changes in the deceleration rate of the car 6.

Figure 7:
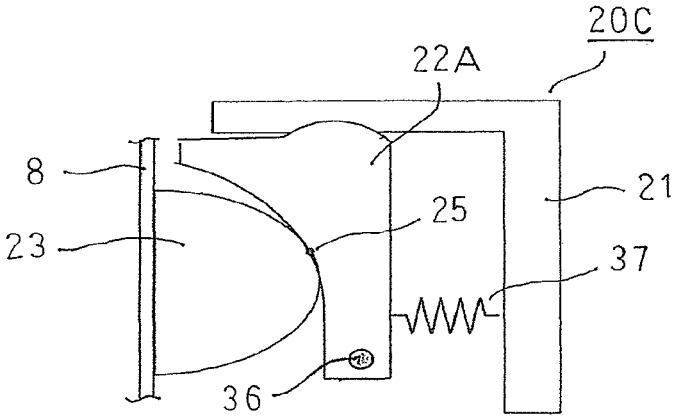
FIG. 7 is a schematic diagram that explains a configuration of a third variation of the elevator emergency safety device according to Embodiment 1 of the present invention.

FIG. 7 is a diagram that shows a third variation of the elevator emergency safety device according to Embodiment 1 of the present invention.

In FIG. 7, a lower end of a movable member 22A is rotatably disposed by means of a rotating shaft 36, and a helical spring 37 that functions as an elastic body is disposed between the movable member 22A and the fixed member 21 so as to force the movable member 22A toward a guide rail 8.

In an emergency safety device 20C that is configured in this manner, the movable member 22A pivots clockwise around the rotating shaft 36 together with ascent of a damper 23, lengthening a distance between the rotating shaft 36 and a contacting portion 25. A height position of the helical spring 37 is adjusted such that a distance between the linking portion of the helical spring 37 with the movable member 22A and the rotating shaft 36 becomes equal to the distance between the rotating shaft 36 and the contacting portion 25 during the course of ascent of the damper 23. The pressing force F1 that acts on the contacting portion 25 thereby increases as the amount of pivoting of the movable member 22A clockwise around the rotating shaft 36 increases, and then decreases after reaching a maximum value. Consequently, the emergency safety device 20C can automatically adjust fluctuations in the braking force F0 so as to suppress changes in the deceleration rate of the car 6.

In this manner, according to Embodiment 1, changes in the deceleration rate of the car 6 can be suppressed by suppressing fluctuations in the braking force F0. Furthermore, because it is not necessary to divide a damper into a wedge-shaped fixed portion that has an outer inclined portion and an inner inclined portion, and a wedge-shaped movable portion that has a braking surface, and it is not necessary to dispose an elastic body that bears the braking force, as it is in conventional emergency safety devices, braking surface area can be ensured without increasing the damper in size, enabling irregularities in braking force to be suppressed. In addition, because increases in the size of the damper can be suppressed, the emergency safety device can be reduced in weight, enabling the electric power utilization efficiency of the elevator system to be increased.

Moreover, the curved surface shapes of the first and second sliding surfaces 22*a* and 23*a* of the movable member 22 and the damper 23 according to Embodiment 1 above are not limited to a portion of a cylindrical surface, for example, provided that the angle θ at the contacting portion 25 is changed continuously by the ascent and descent of the damper 23 relative to the movable member 22. In other words, outer circumferential shapes of the first and second sliding surfaces 22*a* and 23*a* in a plane that is perpendicular to a direction of protrusion of the head portion of the guide rail 8 from the base portion are formed by curved surfaces that are constituted by a portion of any curve, such as a circle, an ellipse, or a sine curve. Furthermore, the two sliding surfaces are not limited to a combination of similar or identical curved surfaces, and may be a combination of different curved surfaces. In other words, one sliding surface may be formed such that an outer circumferential shape in a plane that is perpendicular to the direction of protrusion of the head portion of the guide rail 8 from the base portion is a portion of a circle, and the other sliding surface formed such that an outer circumferential shape in a plane that is perpendicular to the direction of protrusion of the head portion of the guide rail 8 from the base portion is a portion of an ellipse.

Furthermore, in Embodiment 1 above, an oil may be applied in order to reduce frictional force between the first and second sliding surfaces 22*a* and 23*a* of the movable member 22 and the damper 23.

Figure 8:
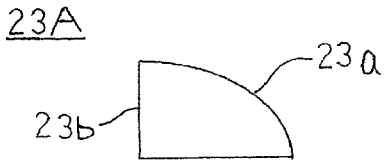
FIG. 8 is a side elevation that shows a first variation of a damper that is used in the elevator emergency safety device according to Embodiment 1 of the present invention.
Figure 9:
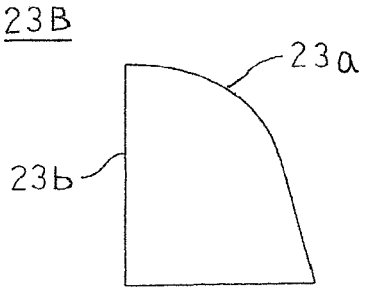
FIG. 9 is a side elevation that shows a second variation of the damper that is used in the elevator emergency safety device according to Embodiment 1 of the present invention.

In Embodiment 1 above, the damper 23 has a D shape that protrudes away from the guide rail 8, but a region below an apex portion of the D shape of the damper 23 is not significant to the braking operation in which the damper 23 is pulled upward by the speed governor rope 10 and wedges between the guide rail 8 and the movable member 22. In other words, the region that is below the apex portion of the damper 23 need only be a shape that does not interfere with the movable member 22 while the damper 23 is operating. Thus, as shown in FIG. 8, a sector-shaped damper 23A can be used in which the region below the apex portion of the D shape is removed. Furthermore, as shown in FIG. 9, a damper 23B can be used in which a region below an apex portion of a D shape is made into a flat surface that is perpendicular to the direction of protrusion of the head portion of the guide rail 8 from the base portion.

In Embodiment 1 above, an emergency safety device 20 that can automatically adjust braking force is disposed on one side of a guide rail 8, but emergency safety devices 20 may be disposed so as to face each other from opposites sides of a guide rail 8. Furthermore, an emergency safety device 20 and a comparative emergency safety device 300 may be disposed so as to face each other from opposites sides of a guide rail 8.

Figure 10:
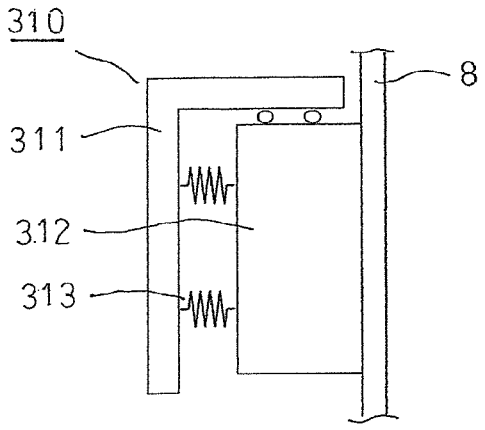
FIG. 10 is a schematic diagram that explains a configuration of an auxiliary emergency safety device that is used in combination with the elevator emergency safety device according to Embodiment 1 of the present invention.
Figure 11:
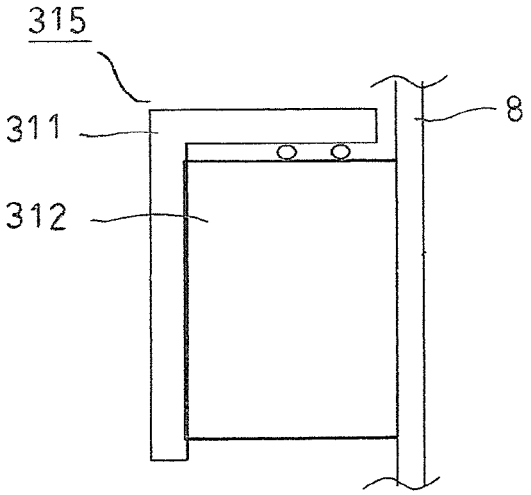
FIG. 11 is a schematic diagram that explains a configuration of another auxiliary emergency safety device that is used in combination with the elevator emergency safety device according to Embodiment 1 of the present invention.

Furthermore, an auxiliary emergency safety device 310 that only has a pressing force and does not have a braking force adjusting function may be disposed so as to face an emergency safety device 20 from an opposite side of a guide rail 8 instead of a comparative emergency safety device 300. As shown in FIG. 10, the auxiliary emergency safety device 310 includes: a fixed member 311 that is mounted to the car 6, and that is disposed on a second side of the guide rail 8 in the width direction; a damper 312 that is disposed between the fixed member 311 and the guide rail 8 so as to be able to reciprocate in the width direction of the guide rail 8; and helical springs 313 that are disposed between the fixed member 311 and the damper 312 that force the damper 312 toward the guide rail 8. As shown in FIG. 11, an auxiliary emergency safety device 315 is constituted by only a fixed member 311 and a damper 312, omitting the helical springs 313, and may be configured so as only to support the pressing force onto the rail 8 from the emergency safety device 20 that can automatically adjust the braking force. Moreover, for simplicity, the emergency safety device 20 is omitted from FIGS. 10 and 11.

Figure 12:
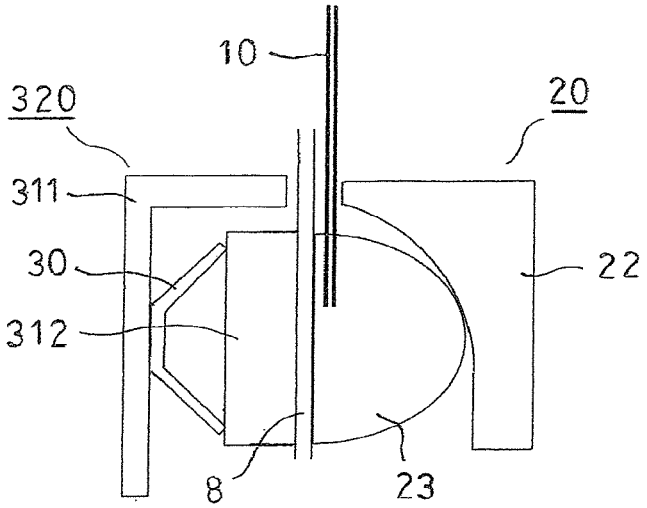
FIG. 12 is a schematic diagram that shows a state in which another auxiliary emergency safety device and the elevator emergency safety device according to Embodiment 1 of the present invention are used in combination.

As shown in FIG. 12, an auxiliary emergency safety device 320 that uses a disk spring 30 instead of the helical springs 313 may be disposed so as to face an emergency safety device 20 from an opposite side of a guide rail 8. Moreover, for simplicity, the fixed member 21 and the elastic body 24 in the emergency safety device 20 are omitted from FIG. 12.

Embodiment 2

Figure 13:
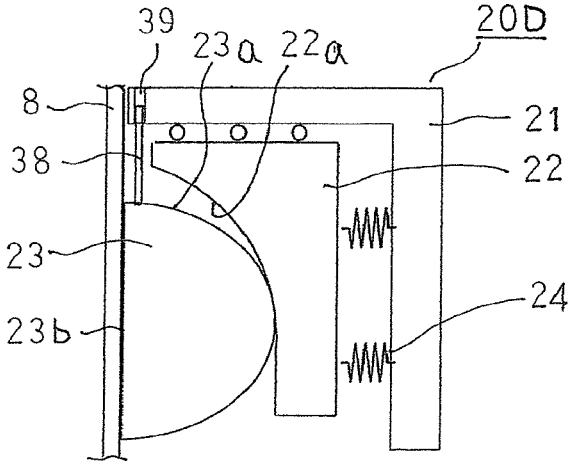
FIG. 13 is a schematic diagram that explains a configuration of an elevator emergency safety device according to Embodiment 2 of the present invention.

FIG. 13 is a schematic diagram that explains a configuration of an elevator emergency safety device according to Embodiment 2 of the present invention.

In FIG. 13, a guiding rod 38 is mounted to a damper 23 so as to protrude upward from an outer circumferential surface of the damper 23 such that a longitudinal direction thereof is vertical when a braking surface 23*b* of the damper 23 contacts a braking surface of a head portion of a guide rail 8, and so as to avoid interference with a movable member 22. A guiding aperture 39 is formed on a fixed member 21 so as to have an aperture direction in a vertical direction. The guiding aperture 39 is formed on the fixed member 21 such that the guiding rod 38 is inserted therein when the damper 23 contacts the braking surface of the head portion of the guide rail 8 and commences ascent. Here, the guiding rod 38 and the guiding aperture 39 constitute a tilt-preventing mechanism.

Moreover, a remainder of the configuration is configured in a similar or identical manner to that of Embodiment 1 above.

In an emergency safety device 20D that is configured in this manner, the first sliding surface 23*a* slides on the second sliding surface 22*a* when the damper 23 is pulled upward by the speed governor rope 10, the damper 23 approaches the guide rail 8 while ascending, and the braking surface 23*b* is placed in contact with the braking surface on the head portion of the guide rail 8. At this point, insertion of the guiding rod 38 into the guiding aperture 39 is commenced. As the damper 23 ascends further, the guiding rod 38 is inserted inside the guiding aperture 39. The damper 23 is thereby guided by the guiding aperture 39, and ascends to generate a braking force F0.

The first and second sliding surfaces 22*a* and 23*a* are in line contact. As the first sliding surface 23*a* slides on the second sliding surface 22*a* and moves upward, the direction of the normal component of reaction Fv at the contacting portion 25 fluctuates. Thus, if there were no tilt-preventing mechanism for the damper 23, it is possible that the damper 23 might tilt during ascent of the damper 23, making movement of the damper 23 unstable.

According to Embodiment 2, a tilt-preventing mechanism that is constituted by a guiding rod 38 and a guiding aperture 39 is included. Thus, because the guiding rod 38 is inserted into the guiding aperture 39 during ascent of the damper 23, the damper 23 is guided by the guiding aperture 39 as it ascends, suppressing the occurrence of tilting. The damper 23 can thereby move stably.

Moreover, in Embodiment 2 above, the guiding rod 38 is mounted to the damper 23, and the guiding aperture 39 is formed on the fixed member 21, but the guiding rod 38 may be mounted to the fixed member 21, and the guiding aperture 39 formed on the damper 23.

Furthermore, in Embodiment 2 above, a vicinity of a tip of the guiding rod 38 may have a tapered shape, and an edge portion of an opening in a vicinity of an entrance of the guiding aperture 39 may have a splayed shape. In that case, the guiding rod 38 is easily inserted into the guiding aperture 39, increasing the stability of the braking operation by the damper 23.

Furthermore, in Embodiment 2 above, a roller may be installed inside the guiding aperture 39, or an oil may be applied. In that case, because friction is reduced during movement of the guiding rod 38 inside the guiding aperture 39, the stability of the braking operation by the damper 23 is increased.

Moreover, in Embodiment 2 above, a tilt-preventing mechanism that is constituted by a guiding rod and a guiding aperture is installed in an emergency safety device according to Embodiment 1 above, but similar or identical effects can also be achieved if the tilt-preventing mechanism in question is installed in an emergency safety device according to another embodiment.

Embodiment 3

Figure 14:
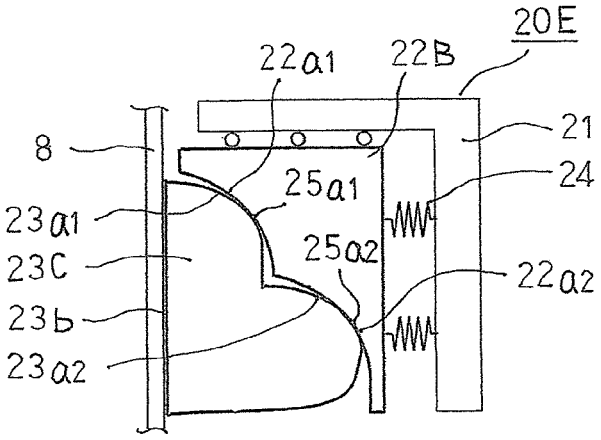
FIG. 14 is a schematic diagram that explains a configuration of an elevator emergency safety device according to Embodiment 3 of the present invention.

FIG. 14 is a schematic diagram that explains a configuration of an elevator emergency safety device according to Embodiment 3 of the present invention.

In FIG. 14, a surface of a movable member 22B on a side near a guide rail 8 is configured so as to have steps that include a first sliding surface segment 22*a*1 and a second sliding surface segment 22*a*2. A surface of a damper 23C on a side near the movable member 22B is configured so as to have steps that include a first sliding surface segment 23*a*1 and a second sliding surface segment 23*a*2. The first sliding surface segment 22*a*1 and the second sliding surface segment 22*a*2 of the movable member 22B are formed so as to have identical curved surface shapes. The first sliding surface segment 23*a*1 and the second sliding surface segment 23*a*2 of the damper 23C are also formed so as to have identical curved surface shapes. In addition, the first sliding surface segments 22*a*1 and 23*a*1 of the movable member 22B and the damper 23C are in line contact with each other at a first contacting portion 25*a*1, and are formed so as to have curved surface shapes in which a horizontal distance from the guide rail 8 becomes shorter continuously and an angle θ at the first contacting portion 25*a*1 increases continuously due to ascent of the damper 23C relative to the movable member 22B. Similarly, the second sliding surface segments 22*a*2 and 23*a*2 of the movable member 22B and the damper 23C are in line contact with each other at a second contacting portion 25*a*2, and are formed so as to have curved surface shapes in which a horizontal distance from the guide rail 8 becomes shorter continuously and an angle θ at the second contacting portion 25*a*2 increases continuously due to ascent of the damper 23C relative to the movable member 22B.

Moreover, a remainder of the configuration is configured in a similar or identical manner to that of Embodiment 1 above.

In an emergency safety device 20E that is configured in this manner, because the movable member 22B and the damper 23C are in line contact at two positions, i.e., the first and second contacting portions 25*a*1 and 25*a*2, the occurrence of tilting during ascent of the damper 23C is suppressed. In other words, the first and second sliding surface segments 22*a*1, 23*a*1, 22*a*2, and 23*a*2 that are configured on the steps of the movable member 22B and the damper 23C constitute a tilt-preventing mechanism for the damper 23C. Consequently, in Embodiment 3, because the occurrence of tilting of the damper 23C during relative ascent of the damper 23C is suppressed, the damper 23C can also move stably in a vertical direction.

In Embodiment 3, because area of the braking surface 23*b* can be ensured without increasing the damper 23C in size, irregularities in braking force F0 can be suppressed, and electric power utilization efficiency of the elevator system can also be increased.

Moreover, in Embodiment 3 above, the second sliding surface of the movable member 22B is formed so as to have steps that are constituted by first and second sliding surface segments 22*a*1 and 22*a*2, and the first sliding surface of the damper 23C is formed so as to have steps that are constituted by first and second sliding surface segments 23*a*1 and 23*a*2, so as to be in line contact at two positions, but the number of contacting portions between the second sliding surface of the movable member and the first sliding surface of the damper is not limited to two, and may be three or more. In that case, the number of steps on the sliding surfaces of the movable member and the damper should be an identical number of steps to the number of contacting portions.

Embodiment 4

Figure 15:
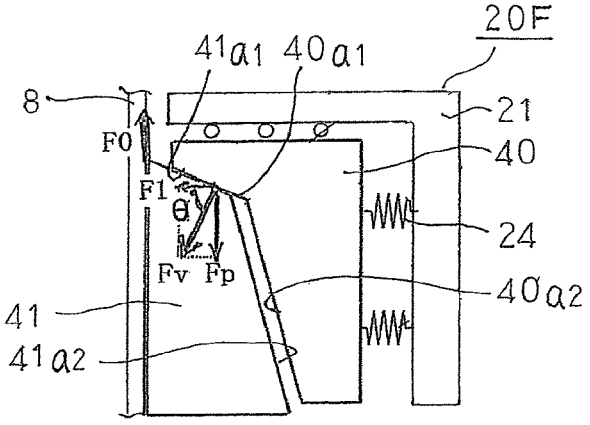
FIG. 15 is a schematic diagram that explains a configuration of an elevator emergency safety device according to Embodiment 4 of the present invention.

FIG. 15 is a schematic diagram that explains a configuration of an elevator emergency safety device according to Embodiment 4 of the present invention. In FIG. 15, a surface of a movable member 40 on a side near a guide rail 8 is configured so as to have a first sliding surface segment 40*a*1 and a second sliding surface segment 40*a*2 that are constituted by flat surfaces that have different angles of inclination than each other. Moreover, the angles of inclination are angles that are formed between the first sliding surface segment 40*a*1 or the second sliding surface segment 40*a*2 and a horizontal plane that is perpendicular to a vertical direction, and the angle of inclination of the first sliding surface segment 40*a*1 is smaller than the angle of inclination of the second sliding surface segment 40*a*2. In other words, the first sliding surface segment 40*a*1 is a flat surface that is closer to the horizontal plane than the second sliding surface segment 40*a*2. A surface of a damper 41 on a side near the movable member 40 is configured so as to have a first sliding surface segment 41*a*1 and a second sliding surface segment 41*a*2 that are constituted by flat surfaces that have different angles of inclination than each other. The first sliding surface segment 40*a*1 of the movable member 40 and the first sliding surface segment 41*a*1 of the damper 41 are formed so as to have identical angles of inclination. The second sliding surface segment 40*a*2 of the movable member 40 and the second sliding surface segment 41*a*2 of the damper 41 are also formed so as to have identical angles of inclination.

In an emergency safety device 20F that is configured in this manner, at the initial commencement of braking, the second sliding surface segment 41*a*2 slides on the second sliding surface segment 40*a*2 of the movable member 40 in a state of surface contact as the damper 41 ascends. Then, when the damper 41 ascends and reaches a state in which the first sliding surface segment 41*a*1 contacts the first sliding surface segment 40*a*1 of the movable member 40, and the second sliding surface segment 41*a*2 contacts the second sliding surface segment 40*a*2 of the movable member 40, the second sliding surface segment 41*a*2 subsequently separates from the second sliding surface segment 40*a*2, and the first sliding surface segment 41*a*1 slides on the first sliding surface segment 40*a*1 in a state of surface contact.

Thus, a horizontal distance between a contacting portion between the movable member 40 and the damper 41 and the guide rail 8 is shortened rectilinearly as the second sliding surface segment 41*a*2 moves upward while sliding on the second sliding surface segment 40*a*2. Similarly, the horizontal distance between the contacting portion between the movable member 40 and the damper 41 and the guide rail 8 is shortened rectilinearly as the first sliding surface segment 41*a*1 moves upward while sliding on the first sliding surface segment 40*a*1. On switching over from a state in which the second sliding surface segment 41*a*2 moves upward while sliding on the second sliding surface segment 40*a*2 to a state in which the first sliding surface segment 41*a*1 moves upward while sliding on the first sliding surface segment 40*a*1, the horizontal distance between the contacting portion between the movable member 40 and the damper 41 and the guide rail 8 approaches discretely.

In the state in which the second sliding surface segment 41*a*2 moves upward while sliding on the second sliding surface segment 40*a*2, the angle θ that is formed between the normals of the second sliding surface segment 40*a*2 and 41*a*2 and a direction away from the guide rail 8 is constant. In the state in which the first sliding surface segment 41*a*1 moves upward while sliding on the first sliding surface segment 40*a*1, the angle θ that is formed between the normals of the first sliding surface segment 40*a*1 and 41*a*1 and the direction away from the guide rail 8 is similarly constant, and is greater than the angle θ in the state in which the second sliding surface segment 41*a*2 moves upward while sliding on the second sliding surface segment 40*a*2.

An elastic body 24 is configured such that, as the damper 41 ascends, a pressing force F1 therefrom increases, is at a maximum when the first sliding surface segment 41*a*1 contacts the first sliding surface segment 40*a*1, before reaching a state in which the second sliding surface segment 41*a*2 contacts the second sliding surface segment 40*a*2, and then decreases.

Moreover, a remainder of the configuration is configured in a similar or identical manner to that of Embodiment 1 above.

In an emergency safety device 20F that is configured in this manner, the pressing force F1 from the elastic body 24 decreases if the braking force F0 increases such that the damper 41 ascends while the first sliding surface segment 41*a*1 contacts the first sliding surface segment 40*a*1. The pressing force F1 from the elastic body 24 increases if the braking force F0 decreases such that the damper 41 descends while the first sliding surface segment 41*a*1 contacts the first sliding surface segment 40*a*1. Consequently, the emergency safety device 20F can suppress changes in the deceleration rate of the car 6 by automatically adjusting so as to suppress fluctuations in the braking force F0.

In Embodiment 4, because area of the braking surface can be ensured without increasing the damper 41 in size, irregularities in braking force F0 can be suppressed, and electric power utilization efficiency of the elevator system can also be increased.

Embodiment 5

Figure 16:
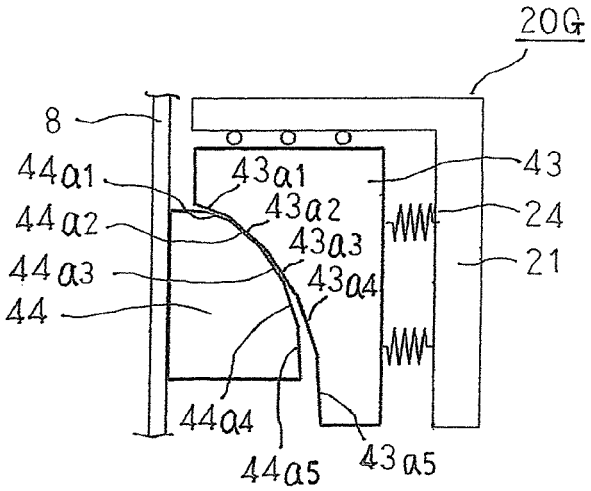
FIG. 16 is a schematic diagram that explains a configuration of an elevator emergency safety device according to Embodiment 5 of the present invention.

FIG. 16 is a schematic diagram that explains a configuration of an elevator emergency safety device according to Embodiment 5 of the present invention.

In FIG. 16, a surface of a movable member 43 on a side near a guide rail 8 is configured by linking first through fifth sliding surface segments 43*a*1, 43*a*2, 43*a*3, 43*a*4, and 43*a*5 that are constituted by flat surfaces that have different angles of inclination relative to a horizontal plane such that the angles of inclination increase gradually downward. A surface of damper 44 on a side near the movable member 43 is configured by linking first through fifth sliding surface segments 44*a*1, 44*a*2, 44*a*3, 44*a*4, and 44*a*5 that are constituted by flat surfaces that have different angles of inclination relative to a horizontal plane such that the angles of inclination increase gradually downward. The first through fifth sliding surface segments 43*a*1, 43*a*2, 43*a*3, 43*a*4, and 43*a*5 of the movable member 43 are each formed so as to have angles of inclination that are respectively identical to those of the first through fifth sliding surface segments 44*a*1, 44*a*2, 44*a*3, 44*a*4, and 44*a*5 of the damper 44.

Vertical widths of each of the first through fifth sliding surface segments 44*a*1, 44*a*2, 44*a*3, 44*a*4, and 44*a*5 of the damper 44 are narrower than the vertical widths of the corresponding first through fifth sliding surface segments 43*a*1, 43*a*2, 43*a*3, 43*a*4, and 43*a*5 of the movable member 43. Thus, as the damper 44 ascends, changes can be made sequentially from a state in which the fifth sliding surface segments 43*a*5 and 44*a*5 slide on each other, to a state in which the fourth sliding surface segments 43*a*4 and 44*a*4 slide on each other, etc., through to a state in which the first sliding surface segments 43*a*1 and 44*a*1 slide on each other. As each change occurs as the damper 44 ascends from the state in which the fifth sliding surface segments 43*a*5 and 44*a*5 slide on each other, to the state in which the fourth sliding surface segments 43*a*4 and 44*a*4 slide on each other, etc., through to the state in which the first sliding surface segments 43*a*1 and 44*a*1 slide on each other, the horizontal distance between the contacting portion between the movable member 43 and the damper 44 and the guide rail 8 approaches discretely.

An angle θ at the contacting portion between the sliding surfaces becomes sequentially greater at the contacting portion between the fifth sliding surface segments 43*a*5 and 44*a*5, the contacting portion between the fourth sliding surface segments 43*a*4 and 44*a*4, etc., through he contacting portion of the first sliding surface segments 43*a*1 and 44*a*1.

An elastic body 24 is configured such that, as the damper 41 ascends, a pressing force F1 therefrom increases, is at a maximum immediately before shifting from the state in which the fourth sliding surface segment 44*a*4 slides on the fourth sliding surface segment 43*a*4 to the state in which the third sliding surface segment 44*a*3 slides on the third sliding surface segment 43*a*3, and then decreases.

Moreover, a remainder of the configuration is configured in a similar or identical manner to that of Embodiment 1 above.

Consequently, in an emergency safety device 20G that is configured in this manner, changes in the deceleration rate of the car 6 can also be suppressed by automatically adjusting so as to suppress fluctuations in the braking force F0, in a similar or identical manner to the emergency safety device 20F in Embodiment 4 above.

In Embodiment 5, because area of the braking surface can be ensured without increasing the damper 44 in size, irregularities in braking force F0 can be suppressed, and electric power utilization efficiency of the elevator system can also be increased.

Embodiment 6

Figure 17:
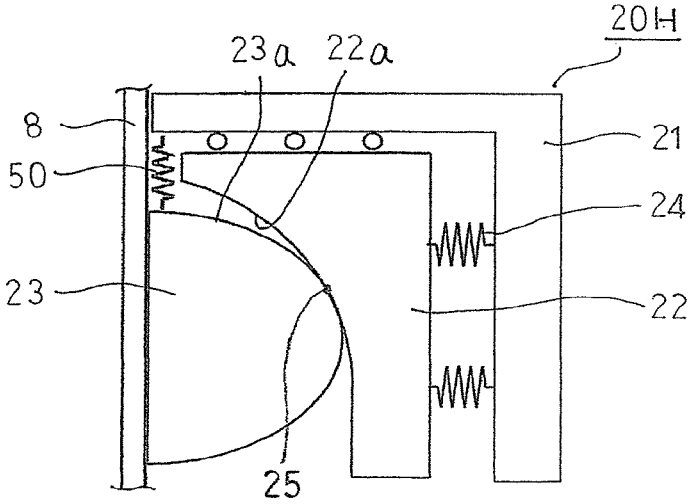
FIG. 17 is a schematic diagram that explains a configuration of an elevator emergency safety device according to Embodiment 6 of the present invention.
Figure 18:
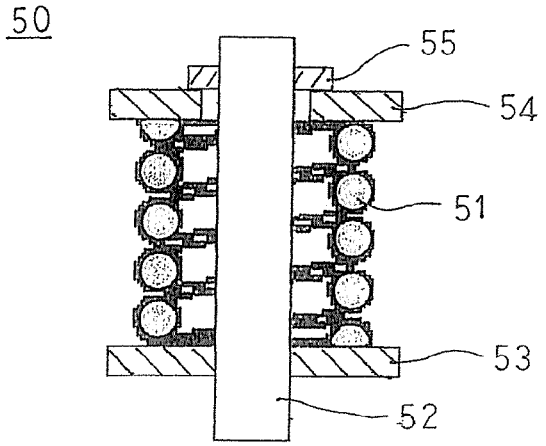
FIG. 18 is a cross section that explains a configuration of a first elastic member that is used in the elevator emergency safety device according to Embodiment 6 of the present invention.

FIG. 17 is a schematic diagram that explains a configuration of an elevator emergency safety device according to Embodiment 6 of the present invention, and FIG. 18 is a cross section that explains a configuration of a first elastic member that is used in the elevator emergency safety device according to Embodiment 6 of the present invention.

In FIGS. 17 and 18, a first elastic member 50 is mounted in a vicinity of an upper end portion of an outer circumferential surface of a damper 23, and is configured so as to come into contact with a fixed member 21 to generate a spring force when the damper 23 moves a fixed amount upward relative to the movable member 22.

The first elastic member 50 includes: a helical spring 51 that is mounted so as to be fitted over a shaft 52; a first spring bearing 53 that is fixed near a first end of the shaft 52; a second spring bearing 54 that is mounted near a second end of the shaft 52 so as to be movable in an axial direction of the shaft 52 so as to clamp the helical spring 51 against the first spring bearing 53; and a nut 55 that is screwed onto the second end of the shaft 52, the helical spring 51 being held between the first and second spring bearings 53 and 54 in a compressed state by fastening the nut 55.

Moreover, a remainder of the configuration is configured in a similar or identical manner to that of Embodiment 1 above.

In an emergency safety device 20H that is configured in this manner, the contacting portion 25 ascends relative to the damper 23 together with increases in the braking force F0, and the pressing force F1 from the elastic body 24 decreases when the pressing force F1 from the elastic body 24 exceeds a maximum value. Fluctuations in the braking force F0 are thereby suppressed, suppressing changes in the deceleration rate of the car 6.

Now, because a vertical component Fp of a normal component of reaction Fv at the contacting portion 25 bears the braking force F0, it is necessary to increase the angle θ at the contacting portion 25 as the braking force F0 is increased.

In this emergency safety device 20H, if the amount of ascent of the damper 23 exceeds a fixed amount, the first elastic member 50 comes into contact with the fixed member 21, generating a spring force that presses the damper 23 vertically downward. Because this spring force from the first elastic member 50 bears a portion of the braking force F0, the vertical component Fp of the normal component of reaction Fv at the contacting portion 25 can be reduced. Thus, it is not necessary to increase the pressing force F1 of the elastic body 24 excessively, increasing the degree of design freedom of the elastic body 24.

Moreover, in Embodiment 6 above, the first elastic member 50 is mounted to the damper 23, but the first elastic member 50 may be mounted to the fixed member 21.

Embodiment 7

Figure 19:
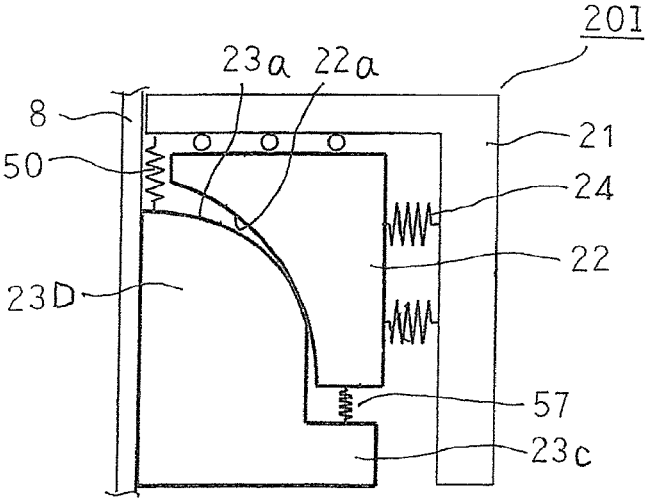
FIG. 19 is a schematic diagram that explains a configuration of an elevator emergency safety device according to Embodiment 7 of the present invention.

FIG. 19 is a schematic diagram that explains a configuration of an elevator emergency safety device according to Embodiment 7 of the present invention.

In FIG. 19, a damper 23D has a bearing portion 22*c* that protrudes outward from a lower end thereof away from a guide rail 8 so as to face a lower end of a movable member 22. A second elastic member 57 is configured in a similar or identical manner to a first elastic member 50, is mounted to a portion of the bearing portion 22*c* that faces the lower end of the movable member 22, and is placed in contact with the lower end of the movable member 22 if the amount of ascent of the damper 23D exceeds a fixed amount, generating a spring force that presses the damper 23D downward.

Moreover, a remainder of the configuration is configured in a similar or identical manner to that of Embodiment 6 above.

In an emergency safety device 20I that is configured in this manner, if the amount of ascent of the damper 23 exceeds a fixed amount, the first elastic member 50 comes into contact with the fixed member 21, generating a spring force that presses the damper 23 downward, and the second elastic member 57 is placed in contact with the lower end of the movable member 22, also generating a spring force that presses the damper 23 downward. Because these vertically downward spring forces from the first and second elastic members 50 and 57 bear a portion of the braking force F0, the vertical component Fp of the normal component of reaction Fv at the contacting portion 25 can be reduced. Consequently, similar or identical effects to those of Embodiment 6 above can also be achieved in Embodiment 7.

Moreover, in Embodiment 7 above, first and second elastic members 50 and 57 are used, but similar or identical effects can also be achieved using only the second elastic member 57.

Moreover, in Embodiments 6 and 7 above, elastic members that apply a downward spring force to a damper are installed in an emergency safety device according to Embodiment 1 above, but similar or identical effects can also be achieved if the elastic members in question are installed in an emergency safety device according to another embodiment.

Embodiment 8

Figure 20:
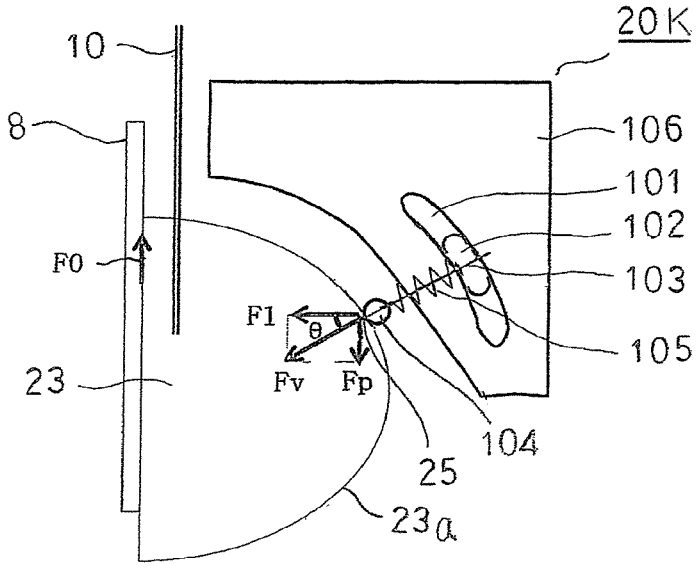
FIG. 20 is a schematic diagram that explains a configuration of an elevator emergency safety device according to Embodiment 8 of the present invention.
Figure 21:
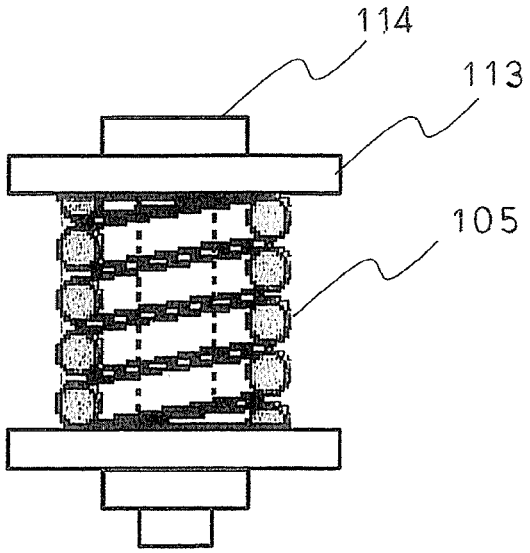
FIG. 21 is a cross section that explains action of a helical spring that is used in the elevator emergency safety device according to Embodiment 8 of the present invention.

FIG. 20 is a schematic diagram that explains a configuration of an elevator emergency safety device according to Embodiment 8 of the present invention, and FIG. 21 is a cross section that explains action of a helical spring that is used in the elevator emergency safety device according to Embodiment 8 of the present invention.

In FIG. 20, a fixed member 106 has a guiding aperture 101, and is fixed to a car 6 (not shown). The guiding aperture 101 is formed so as to have an arc-shaped aperture shape that is parallel to a first sliding surface 23*a* of a damper 23. A slider 102 is slidably disposed in the guiding aperture 101. The slider 102 is formed so as to have an arc-shaped body that can slide in an aperture direction of the guiding aperture 101. A linking shaft 103 is disposed such that an axial direction thereof is oriented in a normal direction of a tangential plane of a first sliding surface 23*a* such that a first end thereof passes through the slider 102 so as to be movable in the normal direction of the tangential plane of the first sliding surface 23*a*. A roller 104 is rotatably mounted to a second end of the linking shaft 103. In addition, a helical spring 105 that constitutes an elastic body is mounted so as to be fitted over the linking shaft 103, and is disposed between the slider 102 and the roller 104.

Moreover, the slider 102, the linking shaft 103, and the roller 104 constitute a movable member. An outer circumferential surface of the roller 104 constitutes a second sliding surface. Furthermore, the first sliding surface 23*a* and the helical spring 105 constitute a pressing force applying portion. The first sliding surface 23*a* forms a curved surface in which an angle θ at a contacting portion 25 with the roller 104 changes continuously due to relative ascent and descent of the damper 23 relative to the movable member 22.

In an emergency safety device 20K that is configured in this manner, the damper 23 is pulled upward relative to the car 6 when a speed governor rope 10 is gripped. The damper 23 is thereby pressed by the helical spring 105 and approaches the guide rail 8 as the first sliding surface 23*a* contacts the roller 104 and moves upward. A braking surface 23*b* that is formed on an opposite side of the damper 23 from the first sliding surface 23*a* is thereby placed in contact with the braking surface on the head portion of the guide rail 8. In addition, the slider 102 slides upward through the guiding aperture 101 as the damper 23 moves upward. The contacting portion 25 between the first sliding surface 23*a* and the roller 104 moves upward relative to the slider 102 together with the movement of the slider 102. Here, the linking shaft 103 displaces such that an angle between the axial direction and the vertical direction is reduced while maintaining an attitude in which the axial direction thereof is the normal of the tangential plane at the contacting portion 25.

As shown in FIG. 21, the helical spring 105 is configured such that no spring force is generated before braking. At the initial commencement of braking, the spring force from the helical spring 105 increases rapidly due to the spring bearing 113 bearing the reaction force of the frictional force F0 and separating from the bolt 114. Because the guiding aperture 101 is formed so as to have an arc-shaped aperture shape that is parallel to the first sliding surface 23*a* of the damper 23, after the spring force from the helical spring 105 exceeds a maximum value, it remains constant at the maximum value since the length of the helical spring 105 barely changes even if the attitude of the linking shaft 103 displaces. In other words, the spring force from the helical spring 105 increases rapidly as the contacting portion 25 moves upward relative to the damper 23, and the maximum value is maintained. However, because mechanical shock at the initial commencement of braking is great, the spring force from the helical spring 105 may increase rapidly, then reach the maximum value, decrease due to reductions in impact force, and become constant. This spring force from the helical spring 105 acts on the contacting portion 25 in the normal direction of the tangential plane at the contacting portion 25. Thus, the normal component of reaction Fv that is generated at the contacting portion 25 between the first sliding surface 23*a* and the outer circumferential surface of the roller 104 is constant. A pressing force F1 (=Fv×cos θ) is generated in the damper 23, and a frictional force F0 (=F1×u) is generated between the guide rail 8 and the damper 23. This frictional force F0 is a braking force.

In the emergency safety device 20K, as the contacting portion 25 moves upward relative to the slider 102, the spring force from the helical spring 105 increases rapidly exceeds the maximum value and is reduced, then becomes constant. The angle θ that is formed between the normal direction of the tangential plane at the contacting portion 25 and the horizontal plane increases monotonically as the contacting portion 25 moves upward relative to the slider 102. Thus, as the position of the contacting portion 25 moves upward, the pressing force F1 at the pressing force applying portion increases, then becomes constant, then decreases. In this emergency safety device 20K also, the braking operation at the initial commencement of braking is performed using the property of the pressing force applying portion until the pressing force F1 reaches the maximum value, and suppression of fluctuations in the braking force F0 is performed using the property of the pressing force applying portion by which the pressing force decreases beyond the maximum value.

In other words, because the contacting portion 25 ascends relative to the damper 23, and the angle θ at the contacting portion 25 increases, if the coefficient of friction μ increases in the region in which the spring force from the helical spring 105 becomes constant, increasing the braking force F0, the horizontal force (Fv×COS θ) is reduced, enabling changes in frictional force F0 to be suppressed. Conversely, because the contacting portion 25 descends relative to the damper 23, and the angle θ at the contacting portion 25 is reduced, if the coefficient of friction μ decreases, reducing the braking force F0, the horizontal force (Fv×COS θ) increases, enabling changes in frictional force F0 to be suppressed.

Thus, in the emergency safety device 20K, it also becomes possible to use the detected braking force F0 to change and automatically adjust the pressing force F1 so as to suppress the fluctuations in the braking force F0, thereby suppressing changes in the deceleration rate.

Here, the initial load on the spring force from the helical spring 105 may be made comparatively small, and the spring force increased in response to the contraction of the helical spring 105. By configuring in this manner, the normal component of reaction Fv due to the linking shaft 103 that has the helical spring 105 can be set to a value that is small compared to the normal component of reaction Fv during the suppression of the changes in the frictional force F0 in order to suppress mechanical shock from the initial stages of braking immediately after the contacting portion 25 ascends relative to the damper 23 and contacts the guide rail 8, and the helical spring 105 contracts as the contacting portion 25 ascends relative to the damper 23 to enable the normal component of reaction Fv that suppresses changes in the frictional force F0 to be achieved.

Moreover, in Embodiment 8 above, the normal component of reaction Fv that is determined by the helical spring 105 is a constant force, but the normal component of reaction Fv that is determined by the helical spring 105 may be changed by forming the aperture shape of the guiding aperture 101 such that a distance between the guiding aperture 101 and the first sliding surface 23*a* becomes gradually shorter as the slider 102 moves upward, for example. In that case, it is necessary for a horizontal force (Fv1×COS θ1) at an angle θ1 to be always less than a horizontal force (Fv2×[[COS θ]] COS θ2) at an angle θ2 that is greater the angle θ1. In other words, it is necessary to satisfy θ1<θ2, and Fv1×cos θ1>Fv2×cos θ2.

Figure 22:
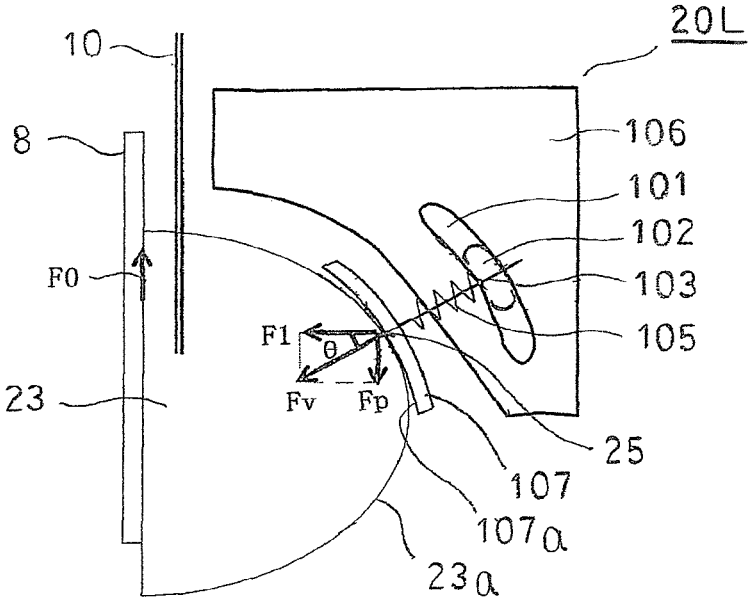
FIG. 22 is a schematic diagram that explains a configuration of a variation of the elevator emergency safety device according to Embodiment 8 of the present invention.

As shown in FIG. 22, a movable member 107 that has a second sliding surface 107*a* that is in line contact with the first sliding surface 23*a* may be disposed on the second end of the linking shaft 103 instead of the roller 104. An emergency safety device 20L, that is configured in this manner also operates in a similar manner.

In Embodiment 8 above, a tilt-preventing mechanism may be added to the damper 23 as in Embodiments 2 and 3 above, and a damper 44 that has a plurality of sliding surfaces may be used instead of the damper 23 as in Embodiment 4 above.

Embodiment 9

Figure 23:
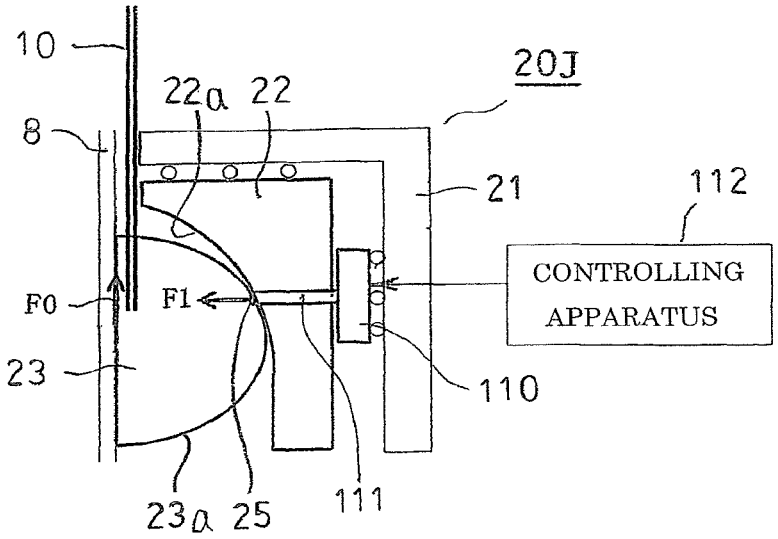
FIG. 23 is a schematic diagram that explains a configuration of an elevator emergency safety device according to Embodiment 9 of the present invention.

FIG. 23 is a schematic diagram that explains a configuration of an elevator emergency safety device according to Embodiment 9 of the present invention.

In FIG. 23, an electromagnetic actuator 110 is disposed on a fixed member 21 so as to be movable in vertical direction so as to avoid interference with a movable member 22, an actuating rod 111 of the electromagnetic actuator 110 has an axial direction oriented in a width direction of a guide rail 8, and is configured so as to press a first sliding surface 23*a* of a damper 23 so as to avoid interference with the movable member 22. A controlling apparatus 112 controls vertical movement of the electromagnetic actuator 110, and also controls driving of the electromagnetic actuator 110 so as to obtain a desired pressing force. Here, the electromagnetic actuator 110 and the controlling apparatus 112 constitute a pressing force applying portion. Moreover, an emergency safety device 20J in Embodiment 9 is configured in a similar or identical manner to Embodiment 1 above except that the electromagnetic actuator 110 and the controlling apparatus 112 are used instead of the elastic body 24.

Here, the vertical movement of the electromagnetic actuator 110 is controlled by the controlling apparatus 112 such that a contacting position of the actuating rod 111 with the first sliding surface 23*a* is at a height position of the contacting portion 25 based on position information for the contacting portion 25 that is calculated from the angle of contact between the first and second sliding surfaces 22*a* and 23*a*. The driving of the electromagnetic actuator 110 is controlled by the controlling apparatus 112 such that as the contacting portion 25 between the first and second sliding surfaces 22*a* and 23*a* moves upward relative to the damper 23, the pressing force F1 from the actuating rod 111 increases rapidly at the initial commencement of braking to the maximum value, and subsequently decreases gradually as the contacting portion 25 moves upward relative to the damper 23, and increases gradually as the contacting portion 25 moves downward relative to the damper 23.

In the emergency safety device 20J that is configured in this manner, the electromagnetic actuator 110 is driven by the controlling apparatus 112 such that the pressing force F1 from the actuating rod 111 acts directly on the first sliding surface 23*a* of the damper 23. A frictional force F0 (=F1×μ) is then generated between the guide rail 8 and the damper 23. This frictional force F0 is a braking force.

In this emergency safety device 20J also, the braking operation at the initial commencement of braking is performed by controlling the driving of the electromagnetic actuator 110 such that the pressing force F1 rises rapidly and reaches a maximum value as the contacting portion 25 moves upward relative to the damper 23, and suppression of fluctuations in the braking force F0 is performed by controlling the driving of the electromagnetic actuator 110 so as to change the pressing force F1 in response to the relative position of the contacting portion 25 relative to the damper 23 after the pressing force F1 exceeds the maximum value.

Thus, if the contacting portion 25 ascends relative to the damper 23 due to the coefficient of friction μ increasing and the braking force F0 increasing, changes in the frictional force F0 can be suppressed by controlling the driving of the electromagnetic actuator 110 so as to reduce the pressing force F1 from the actuating rod 111 to reduce the horizontal force. Conversely, if the contacting portion 25 descends relative to the damper 23 due to the coefficient of friction μ decreasing and the braking force F0 decreasing, changes in the frictional force F0 can be suppressed by controlling the driving of the electromagnetic actuator 110 so as to increase the pressing force F1 from the actuating rod 111 to increase the horizontal force.

Thus, in the emergency safety device 20J, it also becomes possible to use the detected braking force F0 to change and automatically adjust the pressing force F1 so as to suppress the fluctuations in the braking force F0, thereby suppressing changes in the deceleration rate.

In each of the above embodiments, an emergency safety device is mounted to a car, but the hoisted body to which the emergency safety device is mounted is not limited to a car, and may be a counterweight.

The invention claimed is:

1. An elevator emergency safety device comprising:

a damper that is disposed so as to be reciprocally movable in a direction of approach to and a direction of separation from a guide rail, and so as to be movable in a vertical direction along said guide rail, that comprises a first sliding surface on a surface on an opposite side from said guide rail, and that is pressed against said guide rail to generate a braking force;

a movable member that is disposed on a side of said damper near said first sliding surface, and that comprises a second sliding surface that contacts said first sliding surface; and a pressing force applying portion that generates a pressing force that presses said damper against said guide rail, wherein:

said damper is configured so as to be movable in a vertical direction relative to said movable member by said first sliding surface and said second sliding surface sliding; and said pressing force applying portion is configured such that said pressing force increases, reaches a maximum value, and then decreases from that maximum value, as a position of a contacting portion between said first sliding surface and said second sliding surface moves upward, said second sliding surface is a concave curved surface that displaces toward the guide rail progressively upward and said first sliding surface has a convex curved surface that displaces from the guide rail progressively upward from an apex portion; and surfaces where said first sliding surface and said second sliding surface are in contact are configured such that an angle that is formed between a normal of a tangential plane at said contacting portion and a horizontal plane becomes larger together with vertically upward movement of said contacting portion relative to said movable member.

2. The elevator emergency safety device according to claim 1, wherein:

said movable member is disposed between an elevator hoisted body and said damper so as to be reciprocally movable in said direction of approach to and said direction of separation from said guide rail, and is configured so as to move in a direction away from said guide rail together with vertically upward movement of said damper;

said pressing force applying portion comprises an elastic body that is disposed between said movable member and said hoisted body, and that generates said pressing force by displacement due to said movement of said movable member in said direction away from said guide rail; and a spring force from said elastic body is applied to said first sliding surface by means of said movable member.

3. The elevator emergency safety device according to claim 2, wherein:

said first sliding surface and said second sliding surface are configured so as to have curved surfaces that are in line contact at said contacting portion.

4. The elevator emergency safety device according to claim 2, further comprising a tilt-preventing mechanism that guides ascent and descent of said damper along said guide rail.

5. The elevator emergency safety device according to claim 2, further comprising an elastic member that does not apply a spring force to said damper until an amount of ascent of said damper reaches a fixed amount, and that applies a downward spring force to said damper when said amount of ascent of said damper exceeds said fixed amount.

6. An elevator system comprising the elevator emergency safety device according to claim 1.

* * * * *